US006881133B2

(12) United States Patent
Saitoh et al.

(10) Patent No.: US 6,881,133 B2
(45) Date of Patent: Apr. 19, 2005

(54) METHOD OF GRINDING FOR A VERTICAL TYPE OF DOUBLE DISC SURFACE GRINDING MACHINE FOR A BRAKE DISC

(75) Inventors: Akiyoshi Saitoh, Ikeda (JP); Masahiko Hamada, Ikeda (JP)

(73) Assignee: Daisho Seiki Corporation, Ikeda (JP)

( * ) Notice: Subject to any disclaimer, the term of this patent is extended or adjusted under 35 U.S.C. 154(b) by 0 days.

(21) Appl. No.: 10/438,880

(22) Filed: May 16, 2003

(65) Prior Publication Data

US 2004/0029500 A1 Feb. 12, 2004

(30) Foreign Application Priority Data

Aug. 6, 2002 (JP) ..... P2002-228803

(51) Int. Cl.[7] ..... B24B 1/00

(52) U.S. Cl. ..... 451/63; 451/28; 451/41; 451/177; 451/190; 451/194; 451/261; 451/262

(58) Field of Search ..... 451/28, 41, 63, 451/177, 190, 194, 261, 262

(56) References Cited

U.S. PATENT DOCUMENTS

| | | | | |
|---|---|---|---|---|
| 3,721,046 A | | 3/1973 | Dunn | |
| 4,782,631 A | * | 11/1988 | Nishio | 451/262 |
| 6,485,357 B1 | * | 11/2002 | Divine | 451/58 |

FOREIGN PATENT DOCUMENTS

| | | |
|---|---|---|
| JP | 47-002195 | 2/1972 |
| JP | 63-047065 | 2/1988 |
| JP | 06-278021 | 10/1994 |
| JP | 8-504368 | 5/1996 |
| JP | 11-207579 | 8/1999 |

* cited by examiner

*Primary Examiner*—Joseph J. Hail, III
*Assistant Examiner*—Shantese McDonald
(74) *Attorney, Agent, or Firm*—Crowell & Moring LLP

(57) ABSTRACT

A double surface grinding method for a vertical type of double disc surface grinding machine in which upper and lower ground surfaces of a work like a disc brake are ground simultaneously. The entire vertical moving stroke of the grinding wheel includes an idle feed stroke in which the wheel moves at a specified idle feed speed from the waiting position to a detection start position before contacting with the ground surface; a detection stroke in which the wheel moves at a detection speed lower than the idle feed speed from the detection start position to a detection end position after contacting with the ground surface then the wheel detects a grinding start position; and a grinding stroke in which the wheel moves at a grinding speed from the grinding start position to a grinding end position. The grinding start position is set to a position corresponding to a time where a current of the grinding wheel rotation drive motor detected during the detection stroke increases from a value at no-load condition up to a specified value.

5 Claims, 5 Drawing Sheets

METHOD OF GRINDING FOR A VERTICAL TYPE OF DOUBLE DISC SURFACE GRINDING MACHINE FOR A BRAKE DISC

BACKGROUNND OF THE INVENTION

1. Technical Field of the Invention

The present invention relates to a method for an infeed system vertical type of double disc surface grinding machine for a work like a brake disc, in which a pair of upper and lower grinding wheels are vertically opposed each other, they are rotated by rotation drive motors and vertically moved by vertical drive motors, and upper and lower ground surfaces of a work are subjected to surface grinding operation simultaneously.

2. Prior Art

Conventionally, in a method for an in-feed system double surface grinding machine, various measuring apparatuses such as a dial gauge etc. have been used to measure a practical grinding depth on each work and to adjust a grinding allowance, so that the grinding operation has been able to be carried out to always grind a constant grinding allowance according to a scattering of work dimension in pre-grinding and a scattering of work setting height in grinding.

PROBLEMS OF THE PRIOR ART TO BE RESOLVED

In the above mentioned method for measuring a practical grinding depth by using the in-process measuring apparatus, it is required to fit measuring members such as a sensor etc., so that maintenance and adjustment become complicated and the measuring work becomes troublesome.

In addition, in case where a work such as a comparatively thin and small-rigidity plate member as like a brake disc is subjected to the double surface grinding; a grinding start time lag would occur between upper and lower grinding wheels and abilities to correct parallelism and run-out relative to a work reference surface would be worsened due to scattering of accuracy at time of pre-grinding.

OBJECTS OF THE INVENTION

An object of the invention is to provide a method of grinding for a vertical type of double disc surface grinding machine, in which a grinding work can be carried out leaving a constant grinding allowance and providing a good grinding accuracy without employing a new measuring member such as a sensor, even if a work is a plate member having a small rigidity.

SUMMARY OF THE INVENTION

In order to resolve the above problems, in a method of grinding for a vertical type of double disc surface grinding machine, a pair of vertically opposing upper and lower grinding wheels are rotatably driven by grinding wheel rotation drive motors and vertically driven by grinding wheel vertical drive motors respectively, and the both grinding wheels are fed from waiting positions vertically apart from respective upper and lower ground surfaces of a work to a grinding end positions so as to carry out the surface grinding simultaneously on the upper and lower ground surfaces of the work;

characterized by that the entire vertical moving stroke of the grinding wheel includes: an idle feed stroke in which the wheel moves at a specified idle feed speed from the waiting position to a detection start position before contacting with the ground surface; a detection stroke in which the wheel moves at a detection speed lower than the idle feed speed from the detection start position to a detection end position after contacting with the ground surface then the wheel detects a grinding start position; and a grinding stroke in which the wheel moves at a grinding speed from the grinding start position to a grinding end position; and the grinding start position is set to a position corresponding to a time where a current of the grinding wheel rotation drive motor detected during the detection stroke increases, by a specified amount, from a value at no-load condition up to a specified value.

According to the above structure, the grinding start position can be detected easily and the grinding accuracy can be improved on each work even when a scattering of accuracy exists before grinding the work.

Since the grinding start position is detected by sensing a change of current value of the grinding wheel rotation drive motor, it is not required to install a measuring instrument such as the sensor etc., troublesome maintenance and adjustment can be eliminated, and its mechanism becomes not complicated; as compared with the conventional case where the grinding depth is practically measured by using the in-process measuring instruments.

In addition to the above structure, when the upper and lower grinding wheels are switched to the grinding stroke simultaneously by once returning the upper and lower grinding wheels to positions apart from the grinding surfaces after detecting the respective upper and lower grinding start positions by the current change or respective grinding wheel rotation drive motors, deflections of the ground portions in vertical direction during grinding operation can be minimized to improve the grinding accuracy, consumptions of the upper and lower grinding wheels can be made identical to accomplish a long-term stability of the grinding accuracy, in case where a ground portion of the work is a disc member having a small rigidity.

In addition to the above structure, when the grinding stroke is divided into plural strokes including different grinding speeds, the grinding accuracy can be improved adaptable to a thickness of the ground portion.

DETAILED DESCRIPTION OF THE PREFFERED EMBODIMENTS

Figure 1:
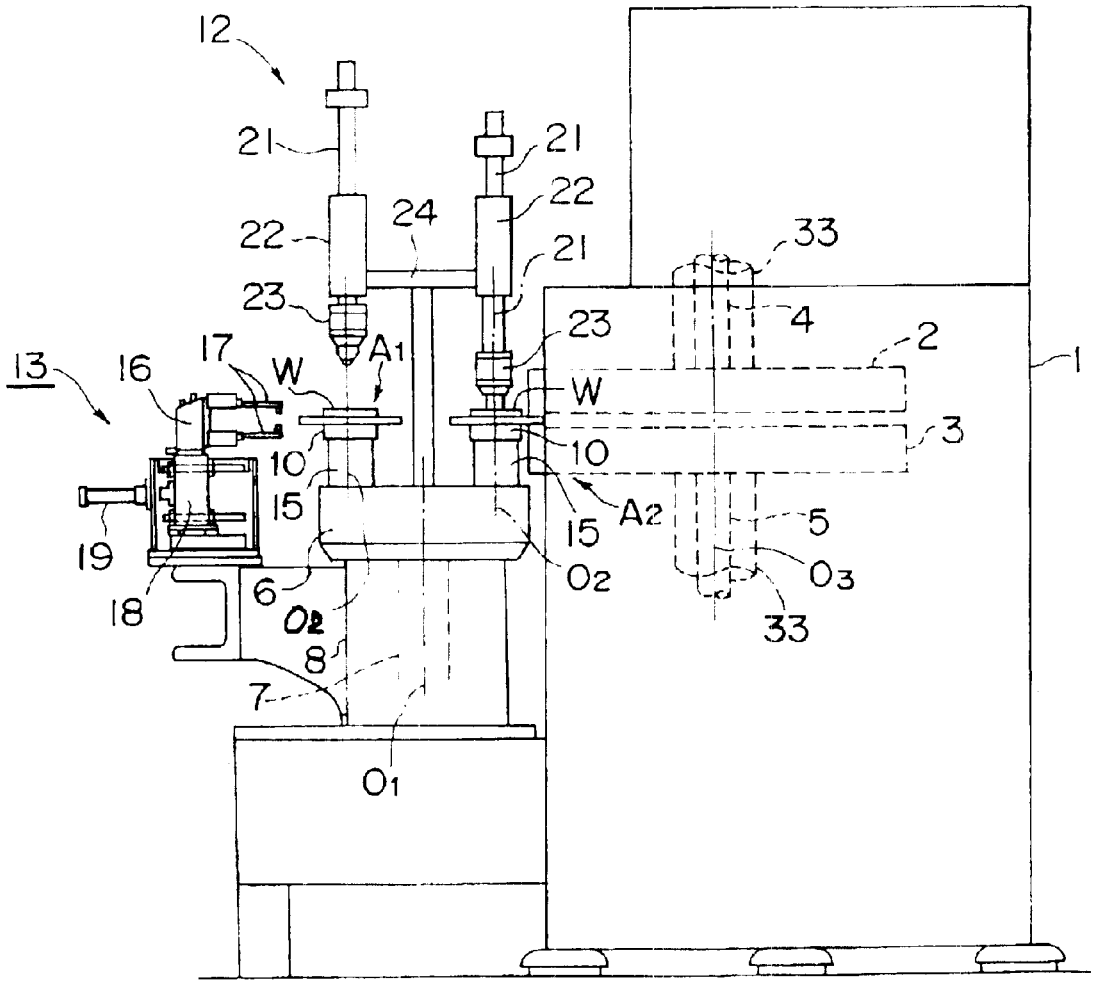
FIG. 1 is a side view of a vertical type of double disc surface grinding machine to which a grinding method of the invention of this application is applied.

FIG. 1 is the side view of the vertical type of double disc surface grinding machine for embodying the grinding method according to the present invention. A pair of upper and lower opposing grinding wheels 2 & 3 are housed in a body case 1, and the upper and lower grinding wheels 2 & 3 are secured to upper and lower grinding wheel shafts 4 & 5 disposed on the same perpendicular axis center O3, respectively. The both grinding wheel shafts 4 & 5 are supported by upper and lower slide cylinders 33 & 33 rotatably and movably in vertical direction.

A work supply index table 6 is secured to an upper end of a vertical table drive shaft 7, and this table drive shaft 7 is supported to a cylindrical support case 8 rotatably around a table rotating axis center O1 through a bearing, and connected and linked to a drive motor through a not-shown transmission mechanism.

On the index table 6, there installed a pair of work holding jigs 10 and a clamp device 12 for clamping the work W from above.

The both work holding jigs 10 are disposed each other around the table axis center O1 with a phase difference of 180°, and supported to a cylindrical jig support case 15 in such a manner as rotatable around a self-rotating center O2. By a half turn of the index table 6, a position change becomes possible between a grinding-wheel-side grinding position A2 for grinding works and an opposing side detaching position A1 for loading and unloading works.

The clamp device 12 is composed of a pair of cylinders 22 having clamp rods 21 extensible in down side and clamp units 23 fitted to bottom ends of the clamp rods 21. Respective cylinders 22 are disposed on the same axis center as the self-rotating axis center O2 of the work holding jig 10 respectively, and fixed to a bracket which is secured to an upper surface of the index table 6, so that these cylinders are rotated together with the work holding jigs 10 around the table rotating axis center O1 by the turning motion of the index table 6.

In the vicinity of the detaching position A1, a dimension measuring instrument 13 for measuring a dimension of the work W before being ground (pre-grinding state) is installed. The dimension measuring instrument 13 is a well-known differential transformer type electric micro-meter equipped with a pair of upper and lower lever-type measuring probes 17. Each measuring probe 17 is so supported as to be able to open and close in a vertical direction, and urged by a spring to a close side. A vertical deviation of the measuring probe 17 is converted to an electrical value such as a current value by using a differential transformer incorporated in a measuring instrument body 16. The electrical value is inputted in a controller 62 (FIG. 2) and indicated on an indication portion of controller panel through an amplifier by means of a digital or indication pointer system. The measuring instrument body 16 is so supported as to be movable in a longitudinal direction through a longitudinal slider 18, and is moved by a longitudinal hydraulic cylinder 19 in front and back sides.

Figure 3:
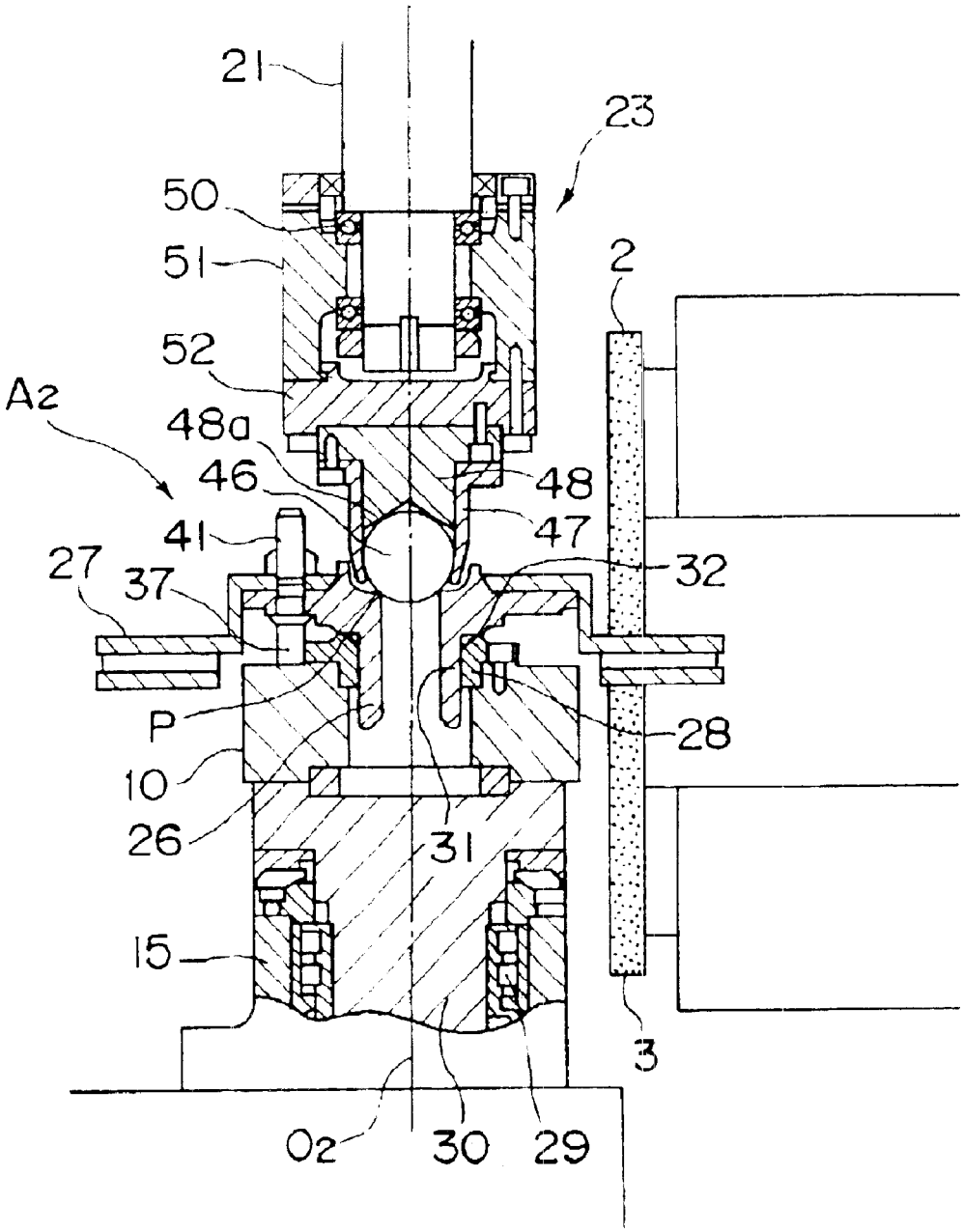
FIG. 3 is an enlarged vertical sectional view of a work holding jig and a work.

FIG. 3 is the enlarged vertical sectional view of the work holding jig 10 and the work W at the grinding position A2. The work W comprises a disc brake for a vehicle for example, and is composed of a hub 26 and an annular disc 27 secured to an upper end flange of the hub 26. Both upper and lower end faces of the disc 27 is subjected to the surface grinding operation.

A self-rotating shaft 30 is supported rotatably in the jig support case 15 though a bearing 29, the work holding jig 10 is secured to an upper end face of the self-rotating shaft 30 on the same axis center as the self-rotating axis center O2, and the bottom end of the self-rotating shaft 30 is connected and linked to a drive motor through a not-shown gear transmission mechanism.

The work holding jig 10 is formed into an annular shape and an annular positioning piece 28 is fixed on top of the jig in a coaxial manner. An annular work reference surface 32 with which a lower surface of the flange of the work W contacts is formed protrusively toward upside, and an inner peripheral surface 31 of the positioning piece 28 is set to a size fitting with the hub 26 of the work W. The work holding jig 10 is provided with an upward projecting stop pin 37 for restricting a rotating movement of the work W relative to the work holding jig 10, and the pin is able to engage with a fitting bolt 41 of the work W in its peripheral direction.

The clamp unit 23 is equipped with a steel ball 46 which contacts with a peripheral edge of a central hole of the work W from upside, a ball retaining cylinder 47 which fits with and supports the steel ball 46 protrusively toward downside, a ball cap 48 which has a conical receiving recessed face 48*a* contacting with an upper face of the steel ball 46, a bearing holder 51 which is supported rotatably around the self-rotating axis center O2 through the bearing 50 by the bottom portion of the clamp rod 21, and a lower cover 52 which is secured to a lower surface of the bearing holder 51. The steel ball 46, the ball retaining cylinder 47, the ball cap 48 and the bearing holder 51 are all arranged on the same axis center as the self-rotating center O2 of the work holding jig 10.

An inner peripheral surface of a lower half of the ball retaining cylinder 47 is formed into a small-diameter tapered shape at its lower part, and the steel ball 46 is held by the tapered shape in a manner as protrusively toward downside. The ball cap 48 fits in the ball cylinder 47 from upside, and is connected to the lower cover 52 together with the ball retaining cylinder 47 in a manner a protrusive toward downside.

Figure 2:
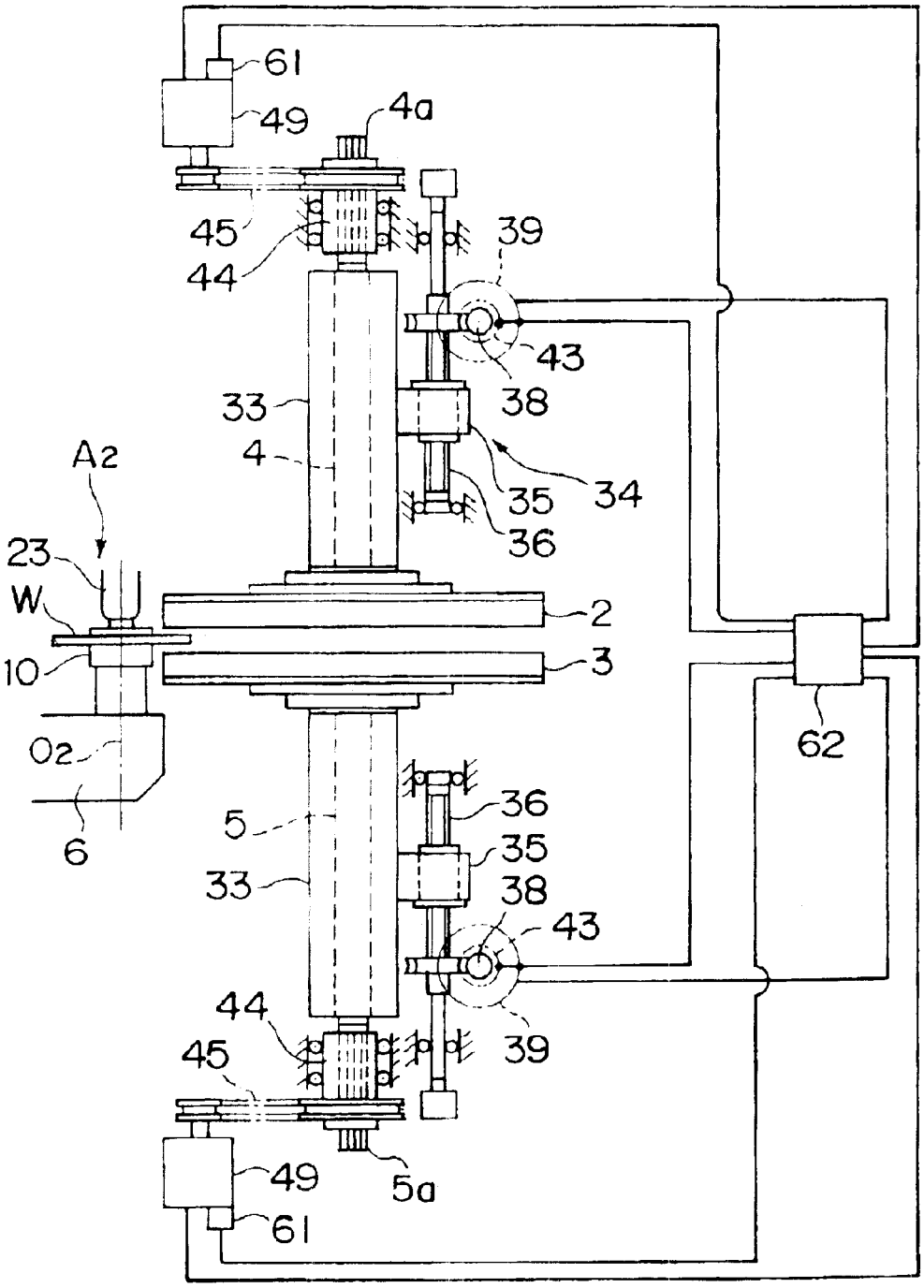
FIG. 2 is a view showing vertical drive and rotation drive mechanisms of grinding wheels.

FIG. 2 is the schematic side view showing one embodiment of the grinding wheel vertical drive mechanism, the grinding wheel rotation drive mechanism and the control mechanism for the aboves.

The upper grinding wheel shaft 4 is rotatably supported in the vertical slide cylinder 33 through a bearing, and is movable in the vertical direction integrally with the vertical slide cylinder 33. The vertical slide cylinder 33 is fixed to a travel nut 35 of a ball screw mechanism 34, the travel nut 35 is vertically movably screwed with a perpendicular feed screw 36 through balls, and the feed screw 36 is connected and linked to an upper grinding wheel vertical drive AC servo motor 39 through a worm gear mechanism 38. Namely, when the grinding wheel vertical drive AC servo motor 39 is rotated, the upper grinding wheel shaft 4 and the upper grinding wheel 2 are moved up and down together with the vertical slide cylinder 33 through the worm gear mechanism 38 and the ball screw mechanism 34.

A rotary encoder 43 is connected to the upper grinding wheel vertical drive AC servo motor 39, and a vertical position and a vertical moving distance (upward or downward distance) of the upper grinding wheel 2 can be detected by detecting a rotation angle of the upper grinding wheel vertical drive AC servomotor 39 by means of the rotary encoder 43. For instance, the rotary encoder 43 has an ability to detect a vertical moving distance of 0.5 $\mu$m by one pulse.

A spline 4*a* is formed on top portion of the upper grinding wheel shaft 4, this spline 4*a* fits with a sprocket 44 having an inner peripheral spline freely slidably in vertical direction, and the sprocket 44 is connected and linked to an upper grinding wheel rotation drive motor 49 through a belt transmission mechanism 45. In other words, when the upper grinding wheel rotation drive motor 49 is rotated; the upper grinding wheel shaft 4 and the upper grinding wheel 2 are rotated through the belt transmission mechanism 45, the sprocket 44 and the spline fitting portion, while permitting vertical movements of the upper grinding wheel shaft 4 and the upper grinding wheel 2. An upper current detector 61 for detecting a current value flowing inside the upper grinding wheel rotation drive motor 49 is installed on the upper grinding wheel rotation drive motor 49 in order to detect the grinding start position of the upper grinding wheel 2 relative to the work W.

A grinding wheel vertical drive mechanism and a grinding wheel rotation drive mechanism for the lower grinding wheel shaft 5 have the fundamentally same structures as those of the grinding wheel vertical drive mechanism and the grinding wheel rotation drive mechanism for the upper grinding wheel shaft 4, and the mechanisms are disposed only symmetrically in vertical direction. Components having the same function are attached with the same symbol marks.

In order to control operations such as turning of ON and OFF, switching of rotation direction in normal and reverse, and rotation speeds of the grinding wheel rotation drive motors 49 & 49 and grinding wheel vertical drive AC servo motors 39 & 39 independently; the motors 39 & 39 and 49 & 49 are connected to the controller 62 incorporating a computer, the upper and lower current detectors 61 & 61 and the upper and lower rotary encoders 43 & 43 etc. are connected to an input part of the controller 62. Current values of the upper and lower grinding wheel rotation drive motors 49 & 49 detected by the current detectors 61 & 61, and rotation angle detection signals of the AC servo motors 39 & 39 detected by the rotary encoders 43 & 43, are inputted in the controller.

In the controller 62, vertical positions and moving distances of the upper and lower grinding wheels 2 & 3 are calculated from rotation angles and rotation numbers of the AC servo motors 39 & 39 detected by the rotary encoders 43 & 43. When the current values inputted from the current detectors 61 & 61 increase by a predetermined value (0.1 ampere, for example) relative to a no-load rotation value (20 to 30 amperes, for example), the controller judges that the grinding wheels 2 & 3 reach the grinding start position and is set to command the rotary encoders 43 & 43 to measure moving distances from the grinding start positions as grinding depths (specified grinding allowances).

[Control of Vertical Moving Length and Vertical Speed of Grinding Wheel]

Figure 4:
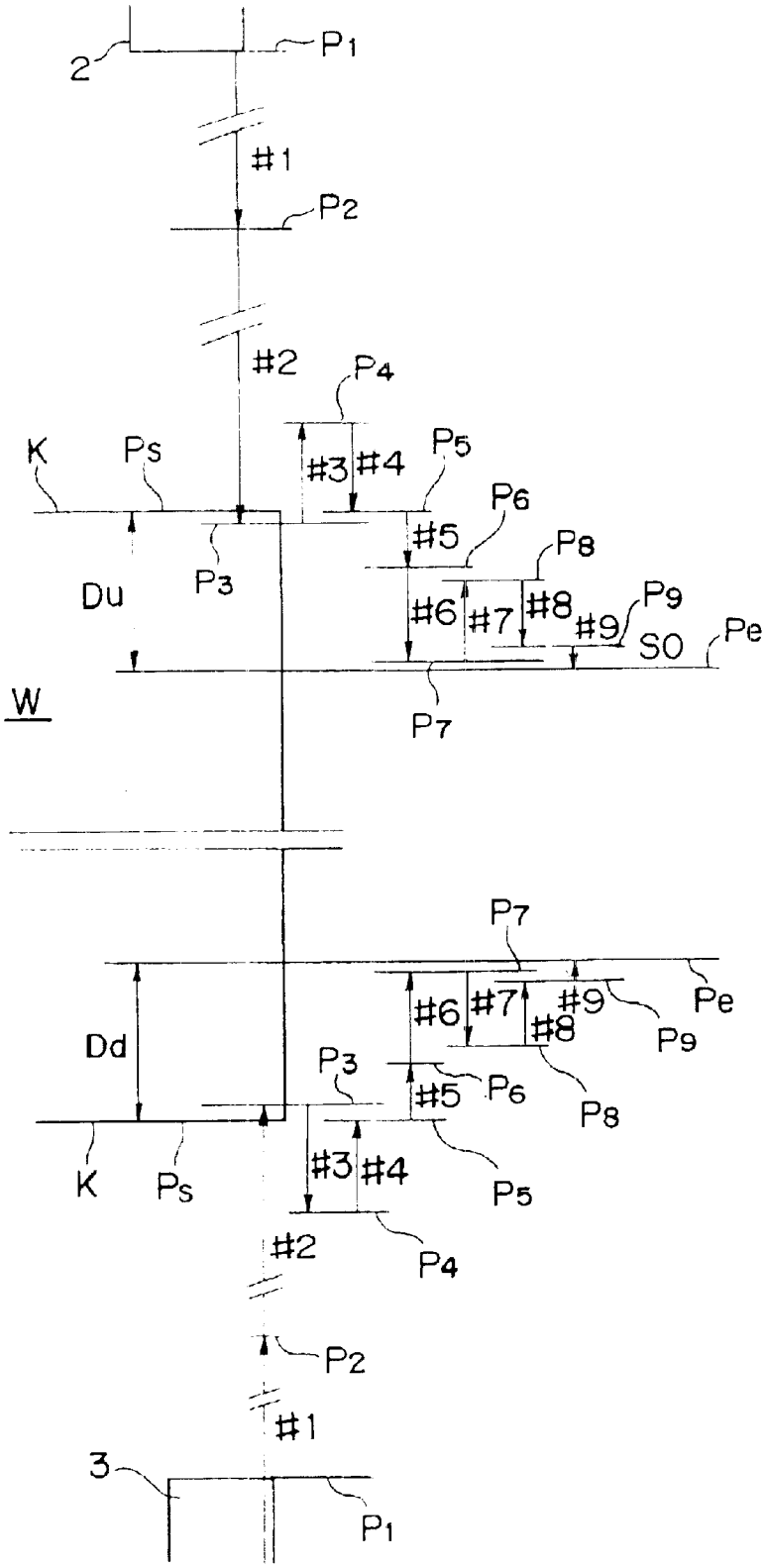
FIG. 4 is an operation explanation diagram showing a moving stroke of grinding wheel.

FIG. 4 shows moving strokes of the upper and lower grinding wheels 2 & 3, and the entire moving stroke from a waiting position P1 to a grinding end position Pe is divided into small strokes #1 to #9 by switching the vertical speed and the moving direction, respectively.

The strokes #1 to #9 relating to the upper grinding wheel 2 will be described hereunder. The first stroke #1 is an idle speed stroke ranging from the waiting position P1 which is apart by about 1 mm from a top ground surface K of the work W, to the detection start position P2 which is apart by 50 $\mu$m from the ground surface K. A downward moving speed is a high speed of about 2,000 $\mu$m/s.

The second stroke #2 is a detection stroke ranging from the detection start position P2 to a detection end position P3 after contacting with the ground surface K. The detection end position P3 is located at a position, by about 5 to 10 $\mu$m, lower than a grinding start position Ps which is detected by contacting with the ground surface K at a load larger than a specified value. A downward moving speed is this second stroke #2 is about 50 $\mu$m/s.

The grinding start position Ps is a position where the current value detected by the upper current detector 61 of FIG. 2 increases by 1.0 ampere from the no-load current value (20 to 30 amperes). This grinding start position Ps becomes a reference position of an upper side grinding depth (grinding amount) Du of the work W.

The third stroke #3 is a first return stroke, rising by 50 $\mu$m, from the detection end position P3 up to an upper return position P4. An upward moving speed in the third stroke #3 is 20 $\mu$m/s.

The fourth stroke #4 is a second idle feed stroke descending from the return position P4 to a position P5 in the vicinity of the grinding start position Ps. A downward moving speed is 100 $\mu$m/s. However, since the ground surface has already been ground from the idle feed end position P5 to the detection terminal position P3 located at a little lower than the grinding start position Ps in the detection stroke #2, the upper grinding wheel 2 does not contact with the top ground surface K of the work at the bottom idle feed end position P5 of the fourth stroke #4.

The fifth stroke #5 is a run-out removal stroke ranging from the idle feed end position PS through contacting with the ground surface K to a run-out removal end position P6 located lower than the surface K by about 35 $\mu$m. A downward moving speed is 10 m/s. In the fifth stroke #5, the ground surface K of the work W is ground within a vertical run-out region.

The sixth stroke #6 corresponds to a practical grinding stroke, and is a middle speed grinding stroke ranging from the run-out removal end position P6 to a grinding middle position P7 located lower than the position P6 by about 50 $\mu$m. A downward moving speed is 20 $\mu$m/s.

The seventh stroke #7 is a return stroke rising, by 40 $\mu$m, from the grinding middle position P7 to an upper second return position P8. An upward moving speed in the seventh stroke #7 is 100 $\mu$m/s.

The eighth stroke #8 is a descending idle feed stroke ranging from the second return position P8 to an upper finish grinding start position P9 located a little upper (5 $\mu$m, for instance) than the grinding middle position P7. A downward moving speed is 100 $\mu$m/s.

The ninth stroke #9 corresponds to a finish grind stroke, and is a low speed grinding stroke ranging from the finish grinding start position P9 to the grinding end position Pe. A downward moving speed is about 5 $\mu$m/s.

A stroke after the ninth stroke #9 is a spark-out stroke in which the grinding wheel carries out the grinding work for a specified time by means of a timer while stopping at the grinding end position Pe. The upper grinding wheel 2 moves upward to the waiting position P1 after completion of the spark-out stroke.

The lower grinding wheel 3 is also provided with nine strokes #1 to #9 and the spark-out stroke in the same way as the upper grinding wheel 2. However, a detection timing of the grinding start position in the detection stroke #2 does not always coincide with that of the upper grinding wheel 2 depending on the condition of pre-grinding. Therefore, in case where the third stroke (return stroke) #3 is switched to the fourth stroke (idle feed stroke) #4, the upper and lower grinding wheels 2 & 3 are synchronized once and so controlled that the upper and lower grinding wheels 2 & 3 are simultaneously switched from the fourth stroke (idle feed stroke) #4 to the fifth stroke (middle speed grinding stroke) #5.

Also when the wheels are switched to the ninth stroke (low speed grinding stroke) #9, the upper and lower grinding wheels 2 & 3 are synchronized once and so controlled that the upper and lower grinding wheels 2 & 3 are simultaneously switched to the ninth stroke #9 in case where the sixth stroke (middle speed grinding stroke) #6 is switched to the seventh stroke (return stroke) #7 and to the eighth stroke (idle feed stroke) #8.

Among the strokes of the upper and lower grinding wheels 2 & 3, moving speeds (grinding speeds) in the strokes #5, #6 & #9 carrying out the practical grinding operations may be set to the same speed for both the wheels. However, when a ground portion having a small rigidity such as a brake disc is ground by the vertical type of double disc surface grinding machine, the ground portion is apt to be deformed upward like a dish. Therefore, the downward moving speed of the upper grinding wheel 2 is controlled to 60% to 70% of the upward moving speed of the lower grinding wheel 3, depending on a thickness or a shape of the ground portion. Thereby, the ground portion of the work W is positively prevented from being deformed upward like a dish during the grinding operation.

[Setting of Waiting Position of Upper and Lower Grinding Wheels]

The waiting positions P1 for the upper and lower grinding wheels 2 & 3 are determined and set on respective works based on work dimensions under pre-grinding conditions measured by the dimension measuring instrument 13, at the detecting position A1 of FIG. 1.

The dimension measuring instrument 13 is subjected to zero-adjustment by using a master gauge corresponding to a finish grinding dimension of the work. At the detecting position A1, the upper and lower ground surfaces of the non-ground work W positioned and clamped by the holding jig 10 are measured by the upper and lower measuring probes 17. Thus, the waiting position P1 is so set that the grinding start position (detection position) Ps in the second stroke (detection stroke) #2 of FIG. 4 coincides roughly with the top ground surface of the non-ground work W, on the basis of the measured value.

[Detection of Grinding Start Position]

Figure 5:
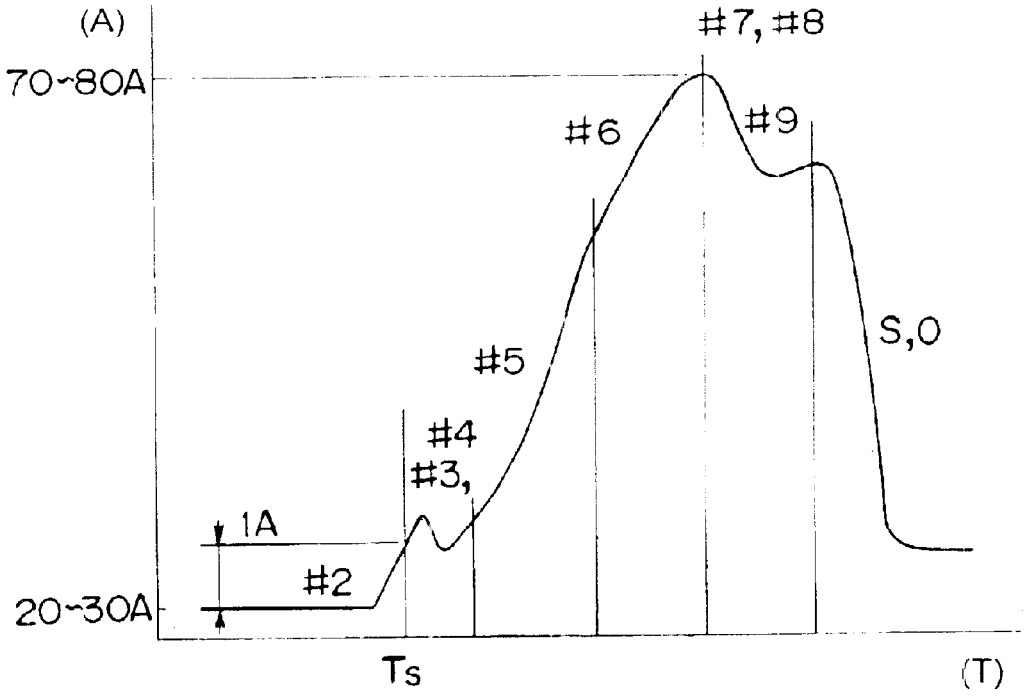
FIG. 5 is a view showing a time-elapse change of current value of a grinding wheel rotation drive motor.

FIG. 5 is the schematic view of current change of the grinding wheel rotation drive motor 49 in the strokes #2 through #9. The ordinate A designates current value (ampere) and the abscissa T designates time. When the grinding wheel 2 begins to contact with the ground surface in the vicinity of the end of the second stroke (detection stroke) #2, the current value abruptly rises up from the no-load value (20 to 30 amperes) Within this rise-up region, a time Ts when the current increases by one ampere from the no-load current value is detected, and a position of grinding wheel corresponding to the time Ts is written in the controller 62 as the grinding start position Ps of FIG. 4.

Incidentally, the current value decreases once in the third stroke (first return stroke) #3 of FIG. 5, the current value increases up to about 70 to 80 amperes through way of the fourth stroke #4, the fifth stroke #5 and the sixth stroke #6. It decreases a little in the seventh stroke (second return stroke) #7 and the eighth stroke (idle feed stroke) #8, and increases again in the ninth stroke (low-speed grinding stroke) #9. Then, it decreases down to the no-load current value in the spark-out stroke.

Figure 6:
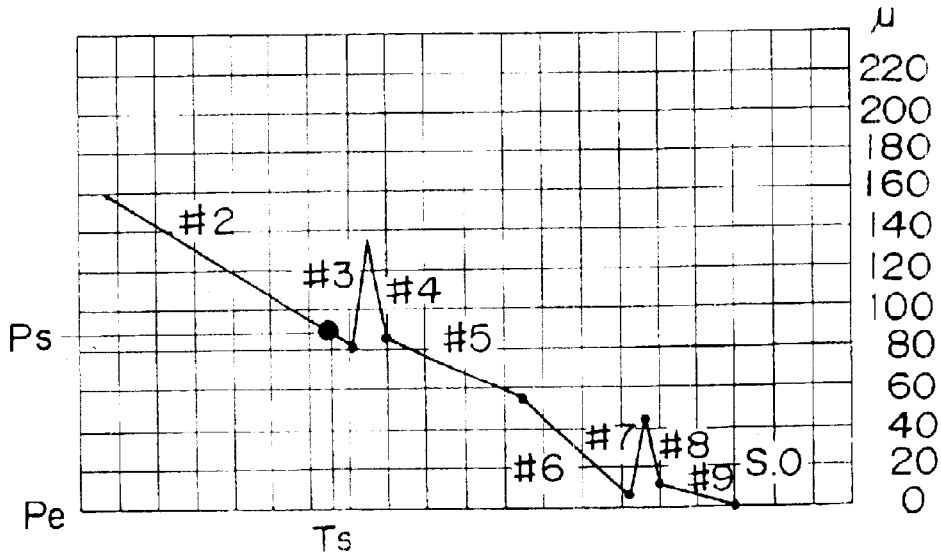
FIG. 6 is a diagram showing feed lengths of grinding wheel at respective strokes.

FIG. 6 is the diagram showing the relation between the grinding wheel moving length or distance and the time in respective strokes #2 through #9. It clearly indicates the change of moving length in the return strokes #3 and #7 and the idle feed strokes #4 and #8.

[Outline of Grinding Method]

Details of grinding works at respective positions have been described, so an outline of the entire grinding work will be described hereunder.

(1) In FIG. 1, at the detaching portion Al; the clamp unit 23 is moved upward, the work W is placed on the work holding jig 10, and the clamp rod 21 is moved downward. Thereby, the clamp unit 23 is pressed onto a central portion of upper surface of the work W.

(2) In FIG. 3, when the work is loaded; the hub 26 of the work W fits in the inner peripheral surface 31 of the positioning piece 28, the flange lower surface of the hub 26 contacts with the annular reference receiving surface 32 of the positioning piece 28, and the stop pin 37 engages with fitting bolt 41 of the work W in the circumferential direction. When the clamp unit 23 is moved downward, under this state; the steel ball 23 is forcedly contacted with the upper end edge of the inner peripheral surface (central hole) of the hub 26, the work W is positioned and fixed at a specified position and is stopped its turning motion relative to the work holding jig 10.

(3) After completion of the clamping operation at the detaching position A1 of FIG. 1, the dimension measuring instrument 13 is moved forward, the upper and lower measuring probes 17 are operated to measure vertical positions of the upper and lower ground surfaces of the annular disc 27 of the non-ground work W, and the results are inputted in the controller 62. On the basis of the above measured values, waiting positions not wastefully leaving apart from the ground surfaces are determined as the waiting positions P1 for the upper and lower grinding wheels 2 & 3 of FIG. 4.

(4) As illustrated in FIG. 2, the position of the work holding jig 10 is changed to the grinding position A2 by a half turn of the index table 6.

(5) After shifting the work W to the grinding position A2, the work holding jig 10 is self rotated to cause the work W rotate around the self rotation axis center O2. The upper grinding wheel 2 is moved downward and the lower grinding wheel 3 is moved upward simultaneously at the same speed. Thereby, the upper and lower specified grinding depths Du & Dd are ground through way of the nine strokes #1 to #9 and the spark out stroke S.O., as shown by FIG. 4.

Namely, the upper and lower grinding wheels 2 & 3 are moved from the waiting position P1 to the detection start position P2 at a high moving speed of 2,000 μm/s, and then moved to the detection end position P3 by decreasing the speed down to 50 μm/s at the position P2. In this second stroke (detection stroke) #2, a position where the current value increases by one ampere is detected and set as the grinding start position Ps, and the wheels return once from the detection end position P3 to the first return position P4 at a speed of 200 μm/s.

At a time when both the upper and lower grinding wheels 2 & 3 return to the first return position P4, the fourth stroke #4 is commenced to idle feed the upper and lower grinding wheels 2 & 3 simultaneously to the idle feed end position P5 (approximate grinding start position Ps) at a speed of 100 μm/s At the idle speed end position P5 (grinding start position Ps), the speed is changed to 10 μm/s and the stroke is switched to the fifth stroke #5 i.e. the run-out removal stroke.

The speed is changed to 20 μm/s at the run-out removal end position P6, the stroke is switched to the sixth stroke #6 i.e. the middle speed grinding stroke. When the wheels reach the grinding middle position P7, the wheels once return to the second return position P8 at a speed of 100 μm/s. The both grinding wheels 2 & 3 are synchronized again and idle fed to the finish grinding start position P9 at a speed of 100 μm/s. The speed is changed to the finish speed 5 μm/s at the finish grinding start position P9, and the stroke is switched to the ninth stroke (finish grinding stroke) #9. Thereby, the finish grinding operation is continued up to the grinding end position Pe.

The grinding wheels spark out for three seconds at the grinding end position Pe, then return to the waiting position P1.

In the above-mentioned grinding work, the surfaces of the non-ground work W attached to the work holding jig 10 are detected for the grinding start position (contacting position) Ps on every work, which will vary depending on scattering of accuracy in the pre-grinding, by measuring the changes of current values of the upper and lower grinding rotation drive motors 49. Then, required grinding allowance are ground so that the stable grinding accuracy can be acquired.

As described above, the grinding start position Ps is detected on every work, and the third stroke (return stroke) #3 and the fourth stroke (idle feed stroke) #4 are carried out before the fifth stroke (run-out removal stroke) #5, thereby the both upper and lower grinding wheels 2 & 3 are synchronized to start the grinding work. Therefore, in case of grinding the both surfaces of thin and small-rigidity work such as the brake disc, the upper and lower grinding wheels 2 & 3 are made simultaneously contact with the upper and lower ground surfaces of the work W to enable starting of the simultaneous grinding operation, so that the parallelism and run-out prevention accuracy of the ground portion can be improved.

OTHER EMBODIMENTS (1) The increase amount of current value forming the setting reference value at the grinding start position is set to 1.0 ampere in the foregoing embodiment, however, it is possible to set the amount to various values proper to respective cases depending on a hardness of the work, a rotation speed or a feed speed of the grinding wheel.

What is claimed is:

1. A grinding method for a vertical type of double disc surface grinding machine for a workpiece in which a pair of vertically opposing upper and lower grinding wheels are rotatably driven by grinding wheel rotation drive motors and vertically driven by grinding wheel vertical drive motors respectively, and both grinding wheels are fed from waiting positions vertically apart from respective upper and lower ground surfaces of a workpiece to a grinding end positions so as to carry out the surface grinding simultaneously on the upper and lower ground surfaces of the workpiece, the movement from the waiting position to the grinding end position being termed the entire vertical moving stroke; wherein:

the entire vertical moving stroke of the grinding wheel includes: an idle feed stroke in which the grinding wheel moves at a specified idle feed speed from the waiting position to a detection start position before contacting with the ground surface; a detection stroke in which the wheel moves at a detection speed lower than the idle feed speed from the detection start position to a detection end position after contacting with the ground surface, then the grinding wheel rotation drive motor detects a grinding start position; and a grinding stroke in which the wheel moves at a grinding speed from the grinding start position to a grinding end position; and the grinding start position is a position corresponding to a time where a current of the grinding wheel rotation drive motor detected during the detection stroke increases, by a specified amount, from a value at no-load condition up to a specified value.

2. A grinding method for a vertical type of double disc surface grinding machine as set forth in claim 1, in which the respective upper and lower grinding start positions are detected by means of the changes of currents of the upper and lower grinding wheel rotation motors, and the upper and lower grinding wheels are returned once to positions apart from the ground surfaces, then the upper and lower grinding wheels are switched to the grinding stroke simultaneously.

3. A grinding method for a vertical type of double disc surface grinding machine as set forth in claim 1 or claim 2, in which the grinding stroke is divided into plural strokes including different grinding speeds.

4. A grinding method for a vertical type of double disc surface grinding machine as set forth in claim 1 or claim 2, wherein said workpiece is a brake disc.

5. A grinding method for a vertical type of double disc surface grinding machine as set forth in claim 3, wherein said workpiece is a brake disc.

* * * * *

US006881133C1

(12) EX PARTE REEXAMINATION CERTIFICATE (5921st)

United States Patent

Saitoh et al.

(10) Number: US 6,881,133 C1

(45) Certificate Issued: Oct. 2, 2007

(54) METHOD OF GRINDING FOR A VERTICAL TYPE OF DOUBLE DISC SURFACE GRINDING MACHINE FOR A BRAKE DISC

(75) Inventors: Akiyoshi Saitoh, Ikeda (JP); Masahiko Hamada, Ikeda (JP)

(73) Assignee: Daisho Seiki Corporation, Ikeda (JP)

Reexamination Request:
No. 90/007,786, Oct. 31, 2005

Reexamination Certificate for:

| | |
|---|---|
| Patent No.: | **6,881,133** |
| Issued: | **Apr. 19, 2005** |
| Appl. No.: | **10/438,880** |
| Filed: | **May 16, 2003** |

(30) Foreign Application Priority Data

Aug. 6, 2002 (JP) ..... P2002-228803

(51) Int. Cl.
*B24B 1/00* (2006.01)

(52) U.S. Cl. ..... 451/63; 451/28; 451/41; 451/177; 451/190; 451/194; 451/261; 451/262

(58) Field of Classification Search ..... 451/41, 451/63

See application file for complete search history.

(56) References Cited

U.S. PATENT DOCUMENTS 4,782,631 A 11/1988 Nishio 4,827,677 A 5/1989 Schmitz

FOREIGN PATENT DOCUMENTS

JP 2000-108003 4/2000

OTHER PUBLICATIONS

Thielenhaus Electrical Schematic Drawing s, four pages, Nov. 15, 1994.

Thielenhaus Machine Drawings, four pages, Mar. 20, 2000.

*Primary Examiner*—Jimmy G. Foster

(57) ABSTRACT

A double surface grinding method for a vertical type of double disc surface grinding machine in which upper and lower ground surfaces of a work like a disc brake are ground simultaneously. The entire vertical moving stroke of the grinding wheel includes an idle feed stroke in which the wheel moves at a specified idle feed speed from the waiting position to a detection start position before contacting with the ground surface; a detection stroke in which the wheel moves at a detection speed lower than the idle feed speed from the detection start position to a detection end position after contacting with the ground surface then the wheel detects a grinding start position; and a grinding stroke in which the wheel moves at a grinding speed from the grinding start position to a grinding end position. The grinding start position is set to a position corresponding to a time where a current of the grinding wheel rotation drive motor detected during the detection stroke increases from a value at no-load condition up to a specified value.

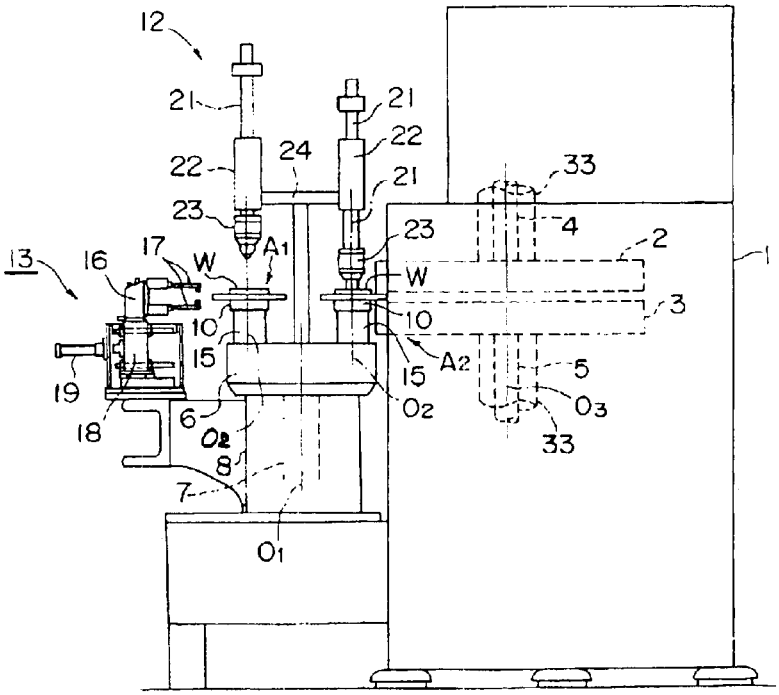

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 2 is confirmed.

Claim 1 is cancelled.

Claims 3 and 4 are determined to be patentable as amended.

Claim 5, dependent on an amended claim, is determined to be patentable.

New claims 6–9 are added and determined to be patentable.

3. A grinding method for a vertical type of double disc surface grinding machine as set forth in [claim 1 or] claim 2, in which the grinding stroke is divided into plural strokes including different grinding speeds.

4. A grinding method for a vertical type of double disc surface grinding machine as set forth in [claim 1 or] claim 2, wherein said workpiece is a brake disc.

*6. A grinding method for a vertical type of double disc surface grinding machine for a workpiece in which a pair of vertically opposing upper and lower grinding wheels are rotatably driven by grinding wheel rotation drive motors and vertically driven by grinding wheel vertical drive*

*motors respectively, and both grinding wheels are fed from waiting positions vertically apart from respective upper and lower ground surfaces of a workpiece to grinding end positions so as to carry out the surface grinding simultaneously on the upper and lower ground surfaces of the workpiece, the movement from the waiting position to the grinding end position being termed the entire vertical moving stroke; wherein:*

*the entire vertical moving stroke of the grinding wheel includes: an idle feed stroke in which the grinding wheel moves at a specified idle feed speed from the waiting position to a detection start position before contacting with the ground surface; a detection stroke in which the wheel moves at a detection speed lower than the idle feed speed from the detection start position to a detection end position after contacting with the ground surface, then the grinding wheel rotation drive motor detects a grinding start position; and a grinding stroke in which the wheel moves at a grinding speed from the grinding start position to a grinding end position; and*

*the grinding start position is a position corresponding to a time, for each wheel, where a current of the grinding wheel rotation drive motor detected during the detection stroke increases, by a specified amount, from a value at no-load condition up to a specified value;*

*whereby the grinding stroke proceeds from the grinding start position simultaneously for the pair of grinding wheels.*

*7. A grinding method for a vertical type of double disc surface grinding machine as set forth in claim 6, in which the grinding stroke is divided into plural strokes including different grinding speeds.*

*8. A grinding method for a vertical type of double disc surface grinding machine as set forth in claim 6, wherein said workpiece is a brake disc.*

*9. A grinding method for a vertical type of double disc surface grinding machine as set forth in claim 7, wherein said workpiece is a brake disc.*

* * * * *